United States Patent [19]

Budzich

[11] 4,089,167

[45] * May 16, 1978

[54] LOAD RESPONSIVE VALVE ASSEMBLIES

[76] Inventor: Tadeusz Budzich, 80 Murwood Dr., Moreland Hills, Ohio 44022

[ * ] Notice: The portion of the term of this patent subsequent to Oct. 12, 1993, has been disclaimed.

[21] Appl. No.: 709,203

[22] Filed: Jul. 27, 1976

Related U.S. Application Data

[63] Continuation-in-part of Ser. No. 522,324, Nov. 8, 1974, Pat. No. 3,998,134, Ser. No. 559,818, Mar. 19, 1975, Pat. No. 3,984,979, and Ser. No. 655,561, Feb. 5, 1976.

[51] Int. Cl.[2] ..... F15B 13/08

[52] U.S. Cl. ..... 60/427; 60/445; 91/412; 91/421; 91/436; 91/446; 137/596.13; 137/596.1

[58] Field of Search ..... 60/427, 445; 91/412, 91/421, 436, 446; 137/596.12, 596.13, 596.1

[56] References Cited

U.S. PATENT DOCUMENTS

| | | | |
|---|---|---|---|
| 3,744,517 | 7/1973 | Budzich | 137/596.1 X |
| 3,807,447 | 4/1974 | Masuda | 137/596.13 |
| 3,984,979 | 10/1976 | Budzich | 60/445 |

*Primary Examiner*—Gerald A. Michalsky

[57] ABSTRACT

A load responsive fluid power multiple load control system using load responsive direction and flow control valves in combination with pump flow control responding to highest system load. Each direction flow control valve is equipped with a load responsive negative load control. The negative load responsive control of each direction control valve blocks the pump flow to the motor while controlling negative load, providing the motor inlet with fluid from the motor exhaust while maintaining a constant pressure in front of a variable flow metering land.

12 Claims, 2 Drawing Figures

LOAD RESPONSIVE VALVE ASSEMBLIES

This is a continuation-in-part of applications Ser. No. 522,324 filed Nov. 8, 1974 for "Load Responsive Fluid Control Valves," now U.S. Pat. No. 3,998,134 Ser. No. 559,818 filed Mar. 19, 1975 for "Load Responsive Fluid Control Valves" now U.S. Pat. No. 3,984,979 and Ser. No. 655,561 filed Feb. 5, 1976 for "Load Responsive Fluid Control System."

BACKGROUND OF THE INVENTION

This invention relates generally to load responsive fluid control valves and to fluid power systems incorporating such valves, which systems are supplied by a single fixed or variable displacement pump. Such control valves are equipped with an automatic negative load responsive control and can be used in a multiple load system, in which a plurality of loads is individually controlled under positive and negative load conditions by separate control valves.

In more particular aspects this invention relates to direction and flow control valves capable of controlling simultaneously a number of loads under both positive and negative load conditions.

In still more particular aspects this invention relates to direction and flow control valves capable of controlling simultaneously multiple positive and negative loads, which while controlling a negative load interrupt pump flow to the motor providing the motor inlet with fluid from the pressurized system exhaust.

In still more particular aspects this invention relates to direction and flow control valves in which the negative load responsive control interrupts pump flow to the motor while maintaining a constant pressure in front of a variable flow metering land.

Closed center load responsive fluid control valves are very desirable for a number of reasons. They permit load control with reduced power losses and therefore, increased system efficiency and when controlling one load at a time provide a feature of flow control irresponsive of the variation in the magnitude of the load. Normally such valves include a load responsive control, which automatically maintains pump discharge pressure at a level higher, by a constant pressure differential, than the pressure required to sustain the load. A variable orifice, introduced between pump and load, varies the flow supplied to the load, each orifice area corresponding to a different flow level, which is maintained constant irrespective of variation in magnitude of the load. The application of such a system is, however, limited by several basic system disadvantages.

These valves while effective when controlling positive loads do not retain flow control characteristics when controlling negative loads, which instead of taking supply the energy to the fluid system and hence the speed of actuation of such a load in a negative load system will vary with the magnitude of the negative load. Especially with socalled overcenter loads, where a positive load may become a negative load, such a valve will lose its speed control characteristics in the negative mode.

This drawback can be overcome by the provision of a load responsive fluid control valve as disclosed in my U.S. Pat. No. 3,744,517 issued July 10, 1973 and my U.s. Pat. No. 3,882,896 issued May 13, 1975. However, while these valves are effective in controlling both positive and negative loads, with pump pressure responding to the highest pressure of a system load being controlled, they still supply, during control of negative loads, the motor inlet with throttled down fluid from the pump circuit, therefore using flow from the pump. In certain fluid power control systems it is preferably, while controlling a negative load, to supply fluid to motor inlet from the motor exhaust circuit instead of using pump capacity.

This drawback can be overcome in part by provision of fluid control valves as disclosed in U.S. Pat. No. 3,807,447 issued to Masuda on Apr. 30, 1974. However, while these valves utilize actuator exhaust fluid for actuator inlet flow requirement when controlling negative loads they regulate actuator inlet pressure by bypassing fluid to a down stream load circuit. Masuda's valves and their proportional control system are based on a series type circuit in which excess fluid flow is successively diverted fron one valve to the other and in which loads arranged in series determine the system pressure. In such a system flow to the last valve operating a load must be delivered through all of the bypass sections of all of the other system valves, resulting in higher fluid throttling loss. These valves are not adaptable to simultaneous control of multiple loads in parallel circuit operation since they do not provide system load control pressure signal to the pump flow control mechanism. When used with variable displacement pumps these valves are not capable of providing sufficient pressurized exhaust flow to actuator inlet during control of negative load to prevent cavitation.

SUMMARY OF THE INVENTION

It is therefore a principal object of this invention to provide a load responsive fluid control system in which improved load responsive fluid direction and flow control valves block system pump from motor inlet and supply it with system exhaust flow when controlling negative loads, while transmitting control signals to system pump to maintain the pressure of the system pump higher, by a constant pressure differential, than the highest pressure of the system positive load being controlled.

Another object of this invention is to provide a load responsive fluid control system in which load responsive fluid direction and flow control valves are provided with load responsive negative load controls which block pump flow to the motor while maintaining a constant pressure in front of a variable flow metering land.

It is another object of this invention to provide a load responsive fluid control system in which load responsive fluid direction and flow control valves are provided with a pressurized exhaust manifold, flow from which supplies the inlet flow requirements of motors controlling negative loads, the system pump being utilized to prevent pressure in the exhaust manifold dropping below a certain predetermined level.

It is another object of this invention to provide a load responsive fluid control system in which load responsive fluid direction and flow control valves retain their control characteristics during control of positive loads, while responding to a pressure differential across a variable orifice located upstream of fluid motor.

Briefly the foregoing and other additional objects and advantages of this invention are accomplished by providing a novel load responsive fluid control system for use during proportional control of positive and negative loads. A system pump is controlled in respect to a pressure signal transmitted from system valves, corresponding to the highest system load pressure and maintains a constant pressure differential between the pump pressure and the highest load pressure of positive loads being simultaneously controlled. The exhaust circuit of the system is pressurized, the exhaust flow being used to provide inlet flow requirements of motors controlling negative loads.

Additional objects of this invention will become apparent when referring to the preferred embodiments of the invention as shown in the accompanying drawings and described in the following detailed description.

DESCRIPTION OF THE PREFERRED EMBODIMENTS

Figure 1:
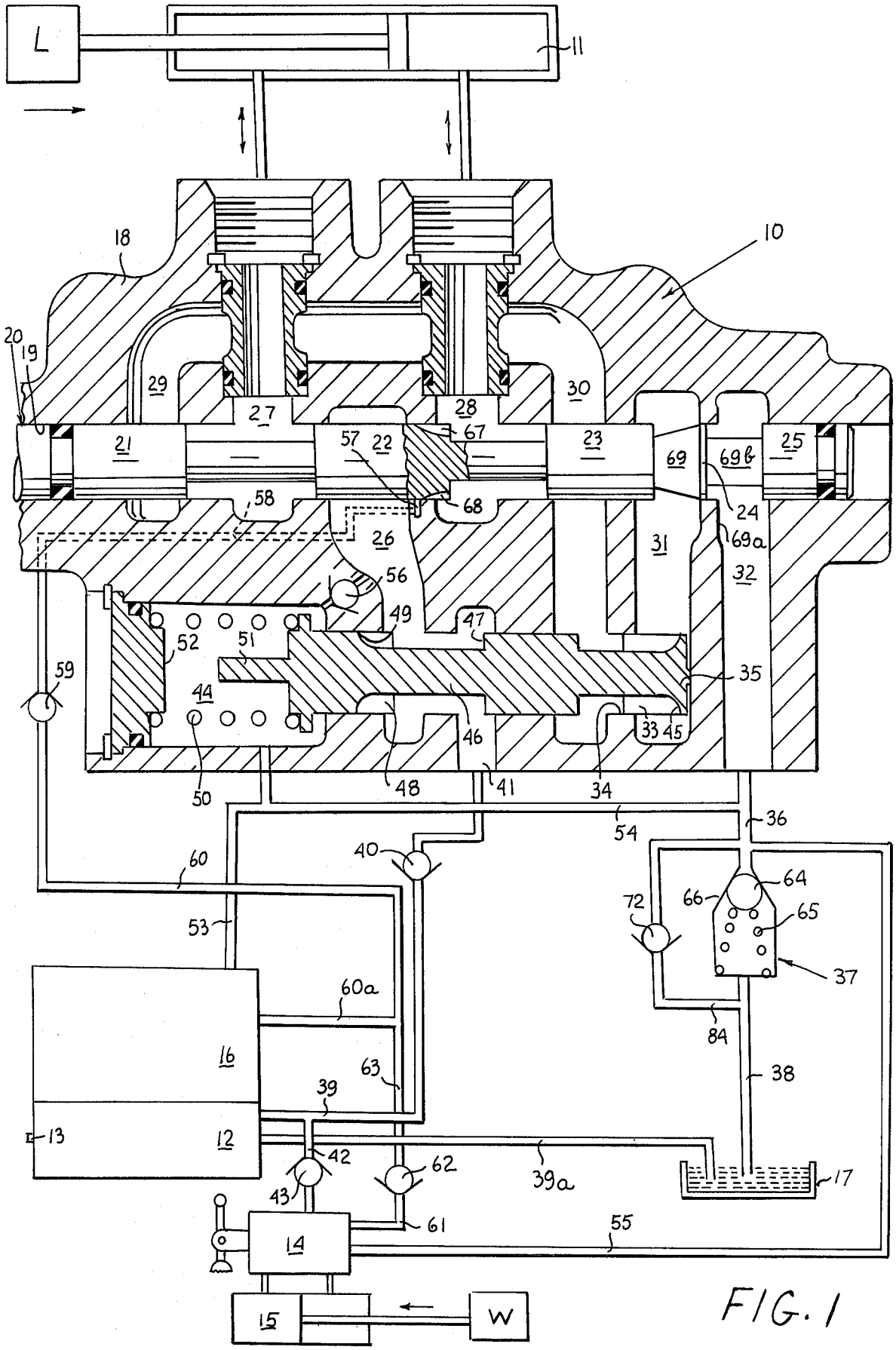
FIG. 1 is a longitudinal sectional view of an embodiment of a flow control valve having a negative load control responsive to actuator down stream pressure for use in load responsive fluid control system, with lines, differential pressure relief valve, fixed displacement pump, second load responsive valve, exhaust relief valve and system reservoir shown diagramatically.

Referring now to the drawings and for the present to FIG. 1, embodiment of a flow control valve, generally designated as 10, is shown interposed between a diagramatically shown fluid motor 11 driving load L and a pump 12 of a fixed displacement type driven through a shaft 13 by a prime mover not shown. Similarly, a flow control valve 14, identical to the flow control valve 10, is interposed between a diagramatically shown fluid motor 15 driving a load W and the pump 12. Fluid flow from the pump 12 to flow control valves 10 and 14 is regulated by a differential pressure relief valve 16 which can be mounted as shown on the pump 12, or be an integral part of the flow control valve 10. If the differential pressure relief valve 16 is made part of the valve assembly it is connected to the fixed displacement pump 12 by a high pressure line capable of transmitting full flow of the pump. The differential pressure relief valve 16, in a well known manner, by bypassing fluid from the pump 12 to a reservoir 17, maintains discharge pressure of the pump 12 at a level, higher by a constant pressure differential, than load pressure developed in fluid motor 11 or 15.

The flow control valve 10 although it can be of a threeway type is shown as a fourway type and has a housing 18 provided with bore 19, axially guiding a valve spool 20. The valve spool 20 is equipped with lands 21, 22 and 23, metering land 24 and land 25. Lands 21, 22 and 23, with valve spool 20 in neutral position, as shown in FIG. 1, isolate a fluid supply chamber 26 from load chambers 27 and 28 also isolating load chambers 27 and 28 from fluid outlet chambers 29 and 30. The metering land 24, in neutral position of valve spool 20, isolates a first exhaust chamber 31 from a second exhaust chamber 32. Land 25 isolates the second exhaust chamber 32 from atmospheric pressure. The outlet chamber 30 is cross-connected through slots 33 and control bore 34 guiding a control spool 35 to the first exhaust chamber 31, the second exhaust chamber 32 is connected through exhaust line 36, an exhaust relief valve, generally designated as 37 and line 38 to the reservoir 17.

The pump 12 through its discharge line 39 and a check valve 40 is connected to a fluid inlet chamber 41. Similarly the pump 12 is connected through discharge line 42 and a check valve 43 to fluid inlet chamber of flow control valve 14. Control bore 34 connects the fluid inlet chamber 41 with the fluid supply chamber 26, the outlet chamber 30, the first fluid exhaust chamber 31 and fluid exhaust space 44. The control spool 35, axially slidable in control bore 34, projects into exhaust space 44 and is provided with slots 33 terminating in throttling edges 45 and stem 46 terminating in cut off plane 47 and slots 48 having connecting edges 49. The control spool 35 is biased by a control spring 50 towards a position, in which slots 33 connect the outlet chamber 30 with the first exhaust chamber 31 and cut off plane 47 permits communication between the fluid inlet chamber 41 and the fluid supply chamber 26. The control spool 35 is equipped with stop 51 which limits travel of control spool 35 by engaging surface 52.

Excess pump flow from the differential pressure relief valve 16 is delivered through line 53 to exhaust line 54. Exhaust line 54 communicates with exhaust space 44, the second exhaust chamber 32 and through line 55 and with all of the exhaust passages of flow control valve 14 and the exhaust relief valve 37, forming a combined system exhaust manifold. A bypass check valve 56 is interposed between exhaust space 44 and the fluid supply chamber 26. In some instances it might be preferable to interpose the bypass check valve 56 between exhaust line 54 and the fluid supply chamber 26.

Positive load sensing port 57, located between load chamber 28 and the supply chamber 26 and blocked in neutral position of valve spool 20 by land 22, is connected through signal passage 58, a check valve 59 and signal lines 60 and **60*a* to the differential pressure relief valve 16. In a similar manner positive load sensing port of flow control valve 14 is connected through line 61, a check valve 62, signal lines 63 and 60*a* to the differential pressure relief valve 16**.

The exhaust relief valve, generally designated as 37, interposed between combined exhaust circuits of flow control valves 10 and 14 including bypass circuit of pump 12 and reservoir 17, is provided with a throttling member 64, biased by a spring 65 towards engagement with seat 66.

Land 22 is provided with first metering slots 67 located between the load chamber 28 and the supply chamber 26. Land 22 is also provided with shorter communication slot 68 located in the plane of load sensing port 57. Metering land 24 is provided on one side with a conical exhaust metering surface 69, projecting into the first exhaust chamber 31 and a stem **69*b*, projecting into the second exhaust chamber 32. The conical exhaust metering surface 69, forming a metering orifice with surface 69*a***, can be substituted, in a well known manner, by shaped metering slots.

The sequencing of the control spool 35 is such that when moved from right to left, when cut off plane 47 closes communication between the inlet chamber 41 and the supply chamber 26, connecting edges 49 of slots 48 are positioned at the point of opening communication between the supply chamber 26 and the exhaust space 44, while full flow communication still exists through slots 33 between the outlet chamber 30 and the first exhaust chamber 31. Further movement of the control spool 35 from right to left will gradually close, with throttling edges 45, communication between the first exhaust chamber 31 and the outlet chamber 30, while full flow communication between the exhaust space 44 and the supply chamber 26 is established.

The preferred timing of connections between the various chambers and the preferred timing between the load chamber 28 and the load sensing port 57 by the valve spool 20 is as follows.

Initial displacement of the valve spool 20 from right to left connects through connecting slot 68 the load sensing port 57 with the load chamber 28, while land 22 still isolates the load chamber 28 from the supply chamber 26, land 21 still isolates the load chamber 27 from the outlet chamber 29 and the metering land 24 still isolates the first exhaust chamber 31 from the second exhaust chamber 32. Further movement to the left of the valve spool 20 connects, through displacement of land 21, the load chamber 27 with the outlet chamber 29 and also through displacement of the metering land 24 the first exhaust chamber 31 with the second exhaust chamber 32, while land 22 still isolates the load chamber 28 from the supply chamber 26. Still further movement to the left of the valve spool 20 connects through metering slots 67 the load chamber 28 and the supply chamber 26, while the load chamber 27 is connected by a comparatively large area for fluid flow through outlet chambers 29 and 30, slots 33 and the first exhaust chamber 31 to the second exhaust chamber 32.

Initial displacement of the valve spool 20 from left to right connects, through displacement of land 23, the load chamber 28 with the outlet chamber 30, while land 22 still isolates the load chamber 27 from the supply chamber 26 and the metering land 24 still isolates the first exhaust chamber 31 from the second exhaust chamber 32. Further movement to the right of the valve spool 20 connects, through displacement of land 22, the load chamber 27 with the supply chamber 26, while metering land 24 still isolates the first exhaust chamber 31 from the second exhaust exhaust chamber 32. Still further movement to the right of the valve spool 20, through displacement of the metering land 24, creates a metering orifice between the metering surface 69 and surface **69*a*, effectively cross-connecting for fluid flow the first exhaust chamber 31 with the second exhaust chamber 32**.

As previously described with flow control valves 10 and 14 controlling loads L and W the differential pressure relief valve 16, in a well known manner, will regulate fluid flow delivered from the fixed displacement pump 12 to discharge line 39, by bypassing the fluid flow to line 53 and exhaust line 54, to maintain the pressure in discharge line 39 higher, by a constant pressure differential, than the highest load pressure signal transmitted through the check valve system to the signal line **60*a*. Therefore with valve spools of flow control valves 10 and 14 in their neutral position, blocking positive load sensing port 57, signal pressure input to the differential pressure relief valve 16 from the signal line 60*a*** will be at minimum pressure level.

With fixed displacement pump 12 started up the differential pressure relief valve 16 will bypass through line 53, exhaust line 54, the exhaust relief valve 37 and line 38 all of pump flow to the system reservoir 17 at minimum pressure level, equivalent to preload in the spring 65, while automatically maintaining pressure in discharge line 39 at a constant pressure, higher by a constant pressure differential, than pressure in signal line **60*a*, which is equal to minimum pressure in exhaust line 54. Therefore all of pump flow is diverted by the differential pressure relief valve 16 to the low pressure exhaust circuit, as previously described, without entering flow passages of flow control valves 10 and 14**.

Assume that while constant standby pressure condition is maintained in discharge line 39 the valve spool 20 is initially displaced from right to left to connect the load chamber 28, through communication slot 68, with the positive load sensing port 57, while lands 21, 22 and 23 isolate load chambers 27 and 28 from the supply chamber 26 and outlet chambers 29 and 30, metering land 24 isolating the first exhaust chamber 31 from the second exhaust chamber 32. Since the load chamber 28 is subjected to pressure supporting load L this load pressure, transmitted through the positive load sensing port 57 and signal passage 58, in a well known manner, will open the check valve 59, close the check valve 62 and reacting through signal lines 60 and **60*a* on the differential pressure relief valve 16 increase pressure in discharge line 39, to maintain a constant pressure differential between the pump pressure in discharge line 39 and load pressure in signal line 60*a*. This pump discharge pressure will be transmitted through discharge line 39 to the fluid inlet chamber 41 and past cut off plane 47 to the fluid supply chamber 26. Since the outlet chamber 30 and the first exhaust chamber 31 are interconnected through slots 33 and subjected to low pressure, the control spool 35 will be in condition of force equilibrium, with the control spring 50 maintaining it in position as shown in FIG. 1**.

Assume that from the position in which the load chamber 28 is connected to the positive load sensing port 57 the valve spool 20 is further displaced to the left, connecting the load chamber 27 with outlet chamber 29 and also connecting the first exhaust chamber 31 to the second exhaust chamber 32, while land 22 still isolates the supply chamber 26 from the load chamber 28. In this position of valve spool 20 communication is established between the load chamber 27 and the exhaust relief valve 37.

Assume that valve spool 20 is further displaced from right to left connecting through metering slots 67 the load chamber 28 with the supply chamber 26, while the area of exhaust passages, subjected to exhaust pressure, leading from the load chamber 27 to the exhaust relief valve 37 is further enlarged. Since the energy from the pump is being used to raise load L the load chamber 28 is subjected to a positive load. The pressure in the load chamber 28 will begin to rise, this change being transmitted through the positive load sensing port 57, in a manner as previously described, to the differential pressure relief valve 16, proportionally increasing the pressure in discharge line 39. This increase in positive load pressure in the load chamber 28 will move load L and start fluid flow into the fluid motor 11. In a well known manner the increasing fluid flow through metering slot 67 will result in an increasing pressure drop, until the pressure drop through metering slots 67 will reach the level of controlling pressure differential of the differential pressure relief valve 16. At this point the system will find itself in a state of equilibrium with the differential pressure relief valve 16 regulating the fluid flow into discharge line 39, to maintain a constant pressure drop across metering slots 67. Therefore area of the orifice through the metering slots 67 will determine the velocity of load L. Change in this orifice area, corresponding to displacement of valve spool 20, will vary proportionally the velocity of load L, each specific position of valve spool 20 corresponding to a specific velocity of load L irrespective of variations in the magnitude of load L.

Assume that the valve spools of flow control valves 10 and 14 were simultaneously actuated to a position, at which fluid flow is delivered to actuators 11 and 15. Assume also that load W is higher than load L and that both loads are positive. In a well known manner, the higher of the load pressures will be transmitted through the check valve system in the load sensing circuit, the differential pressure relief valve 16 always responding to the highest system load pressure. In a manner as previously described, the differential pressure relief valve 16 will automatically maintain a constant pressure differential or constant pressure drop across the metering slots of valve spool of flow control valve 14, permitting proportional control of the velocity of load W, irrespective of the variation in the magnitude of load W. However, flow control valve 10 in a well known manner will lose the proportional flow control feature, the variations in magnitude of load W changing the velocity of load L.

Assume that while constant minimum standby pressure condition is maintained in discharge line 39, the valve spool is initially displaced from left to right connecting the load chamber 28 with the outlet chamber 30, while land 22 still isolates the load chamber 27 from the supply chamber 26 and the metering land 24 still isolates the first exhaust chamber 31 from the second exhaust chamber 32. The load pressure from the load chamber 28 and the outlet chamber 30 will be transmitted through slots 33 to the first exhaust chamber 31 where, reacting on the cross-sectional area of the control spool 35, it will move the control spool 35 all the way from right to left, first closing off with cut off plane 47 communication between inlet chamber 41 and the supply chamber 26. Connecting edge 49 of the control spool 35 is so positioned that while cut off plane 47 is cutting off communication between the inlet chamber 41 and the supply chamber 26, connecting edge 49 is establishing communication between the supply chamber 26 and the exhaust space 44. Further movement to the left of control spool 35 will open wide communication between the supply chamber 26 and the exhaust space 44, throttling edge 45 cutting off communication between the outlet chamber 30 and the first exhaust chamber 31. Total movement of control spool 35 to the left is limited by the stop 51 and surface 52 of the housing 18. Since the first exhaust chamber 31, subjected to pressure and isolated from the outlet chamber 30 by the control spool 35, is subjected to leakage past the metering land 24, the pressure in the first exhaust chamber 31 will begin to drop to a level, at which the biasing force of control spring 50 will move throttling edges 45 of the control spool 35 into a modulating position, at which the pressure in the first exhaust chamber 31 will be maintained at a constant level, as determined by the preload of control spring 50. Since the valve spool 20 was moved from left to right in the direction to lower load L, the load L becomes negative.

Further movement of the valve spool 20 to the right, through displacement of land 22, will open communication between the load chamber 27 and the supply chamber 26, which is cut off from inlet chamber 41 and connected to exhaust space 44 by the control spool 35. In this way the load chamber 27 is connected to the exhaust system of the flow control valve 10, while the metering land 24 still isolates the first fluid exhaust chamber 31 from the second exhaust chamber 32.

Further movement of valve spool 20 to the right will open communication through the exhaust metering surface 69 between the first exhaust chamber 31 and the second exhaust chamber 32. Dropping pressure in the first exhaust chamber 31, reacting on the cross-sectional area of control spool 35 will permit the biasing force of control spring 50 to move the control spool 35 from left to right into a new modulating position, in which the control spool 35, by throttling action of throttling edge 45, will maintain a constant pressure in the first exhaust chamber 31 in front of the orifice created by displacement of the metering surface 69 in respect to surface 69*a*. Therefore for each position of valve spool 20, corresponding to a specific area of flow across exhaust metering surface 69, constant flow will take place from the first exhaust chamber 31 to the second exhaust chamber 32, irrespective of the variation in the magnitude of the negative load in the actuator 11. High pressure flow out of the actuator 11, during control of negative load, will be replenished on the other side of the actuator from the exhaust space 44 through the opening created by displacement of the connecting edges 49 with respect to exhaust space 44, connecting exhaust space 44 and the supply chamber 26 and from exhaust space 44 through the bypass check valve 56, at an increased pressure level of exhaust relief valve 37, while utilizing a combined exhaust flow from the second exhaust chamber 32 and the differential pressure relief valve 16. The exhaust fluid at increased pressure is supplied to the actuator inlet during control of negative load, while the fixed displacement pump 12 is completely isolated by cut off plane 47 from the supply chamber 26 and the actuator 11. Therefore, since none of the potential pump delivery is used as actuator make-up fluid, during control of negative load, higher pump capacity is made available for simultaneous control of multiple positive loads. During control of two negative loads, for example loads L and W, the exhaust circuit is also supplied by line 55 with exhaust fluid from the flow control valve 14 forming a common exhaust manifold, the combined flow of both control valves and the bypass flow from the differential pressure relief valve 16 being available for the make-up flow to the system actuators controlling negative loads, while full pump capacity is being saved for operation of the other positive loads.

When valve spool 20 is moved rapidly from right to left connecting the fluid supply chamber 26 with the load chamber 28, unless the differential pressure relief valve 16 responds fast enough to raise the discharge pressure in the discharge line 39 and the supply chamber 26 to the level, equal to or higher than the load pressure existing in the load chamber 28, a back flow from load chamber 28 to the fixed displacement pump 12 can take place, resulting in momentary drop in load L. To prevent this back flow, check valves 40 and 43 are provided in the pump discharge line. Check valves 40 and 43, while preventing back flow, permit the differential pressure relief valve 16 to raise the pump pressure to a level at which the check valves 40 and 43 will open permitting free flow between the pump and the actuator.

Figure 2:
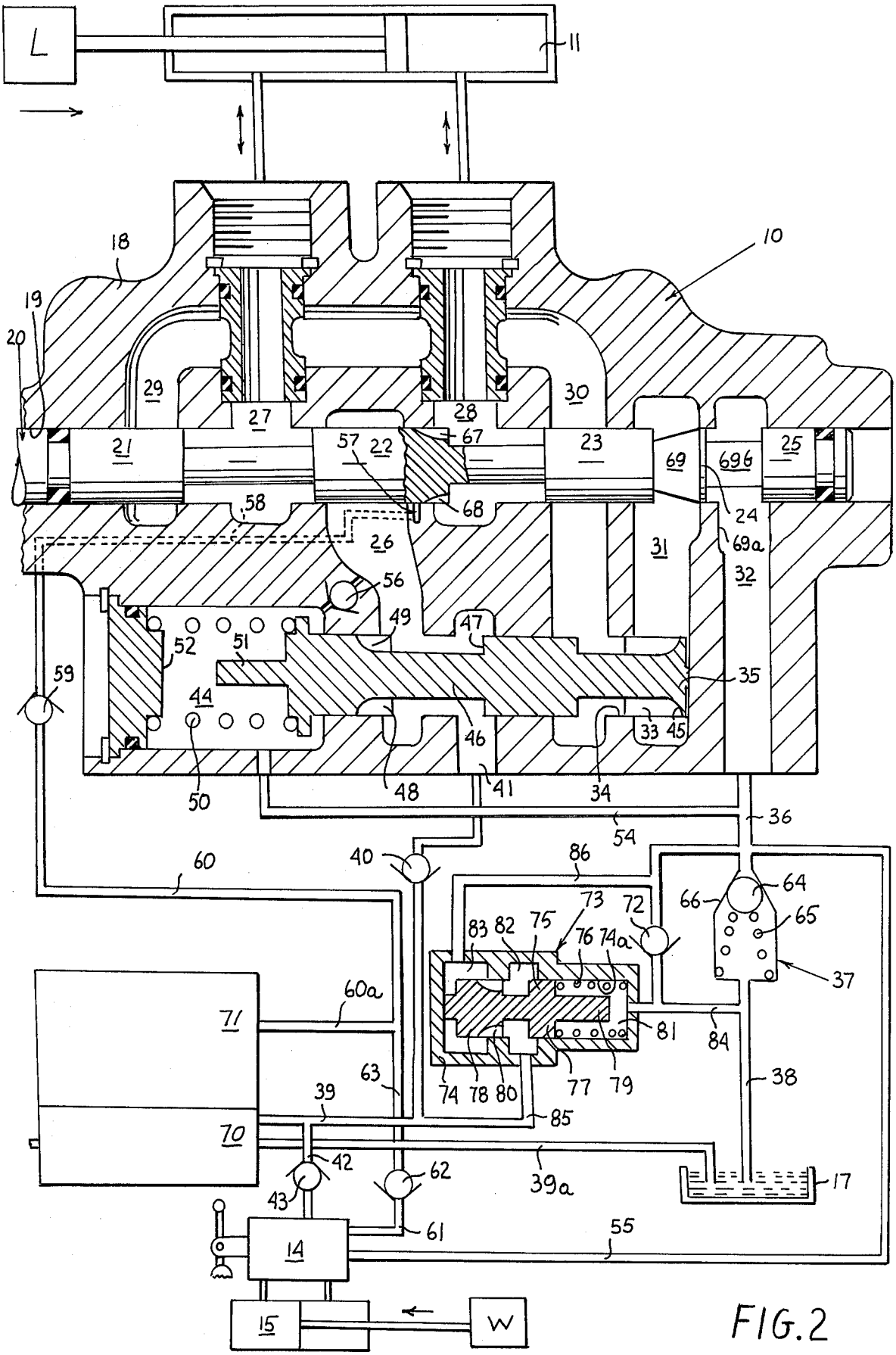
FIG. 2 is a sectional view of an identical embodiment of flow control valve of FIG. 1 used in load responsive fluid control system with lines, variable displacement pump equipped with differential pressure compensator, second load responsive valve, exhaust pressure reducing valve and system reservoir shown diagramatically.

Referring now to FIG. 2 a pump 70 is of a variable displacement type and is controlled by a differential pressure compensator 71 which, in a well known manner, varies the displacement of the pump 70 to maintain discharge line 39 at a pressure, higher by a constant pressure differential, than the load signal pressure transmitted to the differential pressure compensator 71 from the load sensing circuit by signal line 60*a*. Therefore in both systems, as shown in FIGS. 1 and 2, by control of pump flow delivered to discharge line 39, a constant pressure differential is maintained between pressure in discharge line 39 and pressure in signal line 60*a*, in response to highest system load being operated.

The differential pressure compensator 71 may be, in a conventional way, mounted directly on the variable displacement pump 70 or can be made a part of the valve assembly. If the differential pressure compensator 71 is made part of the valve assembly it is connected to the variable displacement pump 70 by three lines, one line at pump discharge pressure, one line at reservoir pressure and one line for conducting of modulated control signal to the displacement changing mechanism of the variable displacement pump 70.

Although the load control features of the systems in FIGS. 1 and 2, as will be shown are identical, the amount of flow delivered to exhaust circuit and specifically to exhaust line 54 is different for each circuit. In FIG. 1 all of the excess pump flow is delivered by the differential pressure relief valve 16 through line 53 to exhaust line 54, since the pump 12 is of a fixed displacement type. With system valve spools in neutral position all of the pump flow is directed by the differential pressure relief valve 16 to exhaust line 54. In FIG. 2 since the pump 70 is of a variable displacement type, it supplies the exact amount of fluid to satisfy the system demand, none of the pump flow being normally diverted to exhaust line 54. Therefore in the arrangement of FIG. 2 less exhaust flow is available to satisfy inlet flow requirements of system actuators during control of negative loads. Normally an actuator, in the form of a cylinder, due to pressure of piston rod, displaces different flows from each cylinder port per unit length displacement of its piston. Therefore, while controlling negative load, the exhaust flow out of the cylinder might be substantially smaller than its inlet flow requirements. Under these conditions, since communication between the inlet chamber 41 and the supply chamber 26 is blocked by the control spool 35, exhaust pressure level, as maintained by exhaust pressure relief valve 37 will drop below atmospheric pressure, the exhaust pressure relief valve 37 will close entirely and cavitation will take place at the inlet side of the cylinder. An anti-cavitation check valve 72 is provided between exhaust line 54 and reservoir 17, but since it can only function below atmospheric pressure due to resistance to flow of metering passages the cavitation condition at actuator inlet would likely occur. To prevent cavitation and to maintain exhaust line 54 at minimum pressure level a pressure reducing valve, generally designated as 73, is provided. Pressure reducing valve 73 has a valve housing 74 provided with a valve bore 74*a* axially guiding a valve spool 75 which is biased towards position as shown in FIG. 2 by a spring 76. The valve spool 75 is provided with lands 77 and 78, stop 79 and throttling slots 80. The valve housing 74 is provided with space 81 and chambers 82 and 83. Space 81 is connected through line 84 with the reservoir 17. The chamber 82 is connected by line 85 with discharge line 39, which is supplied with fluid under pressure from the pump 70. The chamber 82 is connected by line 86 with exhaust line 36. Fluid under pressure is supplied from pump 70, discharge line 39 and line 85 to the chamber 82 and through throttling slots 80 to the chamber 83, which is connected by line 86 with exhaust line 36. Pressure in the chamber 83 and in the exhaust system will begin to rise and reacting on the cross-sectional area of valve spool 75 will tend to move it from left to right, compressing the spring 76 and closing the passage through throttling slots 80 between chambers 83 and 82. In this way pressure reducing valve 73 will throttle fluid flow from chamber 82 to chamber 83 and therefore to exhaust line 36, to maintain exhaust line 54 at a constant pressure, as dictated by the preload in the spring 76. This constant controlled pressure level is selected below controlled pressure level of exhaust pressure relief valve 37. As long as the exhaust pressure relief valve 37 maintains the exhaust system at its controlled pressure level, communication between chambers 83 and 82 of pressure reducing valve 73 will be closed and no flow from the pump 70 will be diverted into the exhaust circuit, tó maintain it at a minimum constant pressure level. However, during control of negative load, once the actuator inlet flow requirement will exceed the actuator outlet flow, the exhaust pressure relief valve 37 will close, pressure in the exhaust system will drop to the control pressure setting of the pressure reducing valve 73 and the motor exhaust flow will be supplemented from the pump circuit by the pressure reducing valve 73, to maintain the actuator inlet at the required pressure. Therefore during control of negative load only the difference between the fluid motor inlet flow requirement and the fluid motor exhaust flow will be supplied to the exhaust circuit from the pump 70. This feature not only improves the efficiency of the system, but greatly extends the capacity of the pump of variable displacement type, to perform useful work in control of positive loads.

In FIG. 1 the differential pressure relief valve 16, by bypassing flow from the fixed displacement pump 12, maintains a constant preselected pressure differential between pressure in discharge line 39 and load signal pressure in pressure signal line 60*a*. In FIG. 2 the differential pressure compensator 71 automatically varies displacement of the variable displacement pump 70, to maintain a constant preselected pressure differential between pressure in discharge line 39 and load signal pressure in pressure signal line 60*a*. Therefore the same load responsive flow control valve 10 can be used in FIGS. 1 and 2, the flow control valve 10 performing in an identical way, while connected to a fixed displacement pump equipped with differential pressure relief valve or a variable displacement pump equipped with a differential pressure compensator control.

Although the preferred embodiments of this invention have been shown and described in detail it is recognized that the invention is not limited to the precise form and structure shown and various modifications and rearrangements as will occur to those skilled in the art upon full comprehension of this invention may be resorted to without departing from the scope of the invention as defined in the claims.

What is claimed is:

1. Multiple load responsive valve assemblies each comprising a housing having a fluid inlet chamber connected to pump means, a fluid supply chamber, at least one load chamber, a fluid outlet chamber, a fluid exhaust chamber and fluid exhaust means connected to reservoir means, first valve means for selectively interconnecting said fluid load chamber with said fluid supply chamber and said fluid outlet chamber, said first valve means having first variable metering orifice means operable to throttle fluid flow between exhaust chamber and said fluid exhaust means and second variable orifice means operable to throttle fluid flow between said fluid supply chamber and said load chamber, load sensing port means selectively communicable with said load chamber by said first valve means, second valve means having out flow throttling means between said outlet chamber and said fluid exhaust chamber responsive to pressure upstream of said first variable orifice means, said second valve means having fluid isolating means between said fluid inlet chamber and said fluid supply chamber, fluid replenishing means to interconnect for fluid flow said fluid supply chamber and said fluid exhaust means when said fluid isolating means isolates said fluid supply chamber and said fluid inlet chamber, and control means connected to said inlet chambers of said valve assemblies, control line means interconnecting said control means with said pressure sensing port means of said valve assemblies, control signal direction phasing means in each of said control line means, said control means responsive to highest pressure in any of said load chambers of valve assemblies operating loads and operable to vary fluid flow delivered from said pump means to said load system to maintain a constant pressure differential across said second variable orifice means between pressure in said inlet chambers and said maximum pressure in said load chamber.

2. Multiple load responsive valve assemblies as set forth in claim 1 wherein said first valve means includes a valve spool axially guided in a valve bore and movable from a neutral position to at least two actuated positions, said valve spool isolating said load chamber from said supply chamber and said fluid outlet chamber when in neutral position and when displaced from neutral position to one of at least two actuated positions first uncovering a control signal passage means in the region of said spool bore between said load chamber and said fluid supply chamber.

3. Multiple load responsive valve assemblies as set forth in claim 1 wherein said fluid replenishing means have fluid connecting means on said second valve means operable to connect for fluid flow said fluid supply chamber with said fluid exhaust means when said fluid isolating means isolates said fluid inlet chamber from said fluid supply chamber.

4. Multiple load responsive valve assemblies as set forth in claim 1 wherein said fluid replenishing means have suction check valve means interconnecting for one way fluid flow said fluid exhaust means and said fluid supply chamber.

5. Multiple load responsive valve assemblies as set forth in claim 4 wherein duct means interconnect said fluid exhaust means of said valve assemblies with said reservoir means, exhaust pressure relief valve means in said duct means interposed between said valve assemblies and said reservoir means said suction check valve means interconnecting said fluid supply chambers of said valve assemblies with said duct means upstream of said exhaust pressure relief valve means.

6. Multiple load responsive valve assemblies as set forth in claim 5 wherein constant pressure reducing valve means interconnect said inlet chambers of said valve assemblies and said duct means upstream of said exhaust pressure relief valve means and operable to maintain said duct means upstream of said exhaust pressure relief valve means at a constant pressure level lower than pressure setting of said exhaust pressure relief valve means when said exhaust pressure relief valve means stop passing fluid from said load responsive valve assemblies to said reservoir means.

7. Multiple load responsive valve assemblies as set forth in claim 1 wherein said control means has fluid bypass means to vary fluid flow delivered from said pump means to said valve assemblies and fluid conducting means to conduct said fluid from said bypass means to said fluid replenishing means.

8. Multiple load responsive valve assemblies as set forth in claim 1 wherein said control means has pump displacement changing control means to vary fluid flow delivered from said pump means to said multiple load responsive valve assemblies.

9. Multiple load responsive valve assemblies as set forth in claim 1 wherein check valve means are interposed between said pump means and each of said inlet chambers to prevent fluid back flow from said inlet chambers to said pump means.

10. Multiple load responsive valve assemblies as set forth in claim 1 wherein said out flow throttling means has means operable to control fluid flow from said outlet chamber to said exhaust chamber to maintain said pressure in said exhaust chamber at a relatively constant preselected level when one of said load chambers is connected to said outlet chamber and said load chamber is pressurized.

11. Multiple load responsive valve assemblies as set forth in claim 1 wherein said control signal direction phasing means include check valve means.

12. Multiple load responsive valve assemblies each comprising a housing having a fluid inlet chamber connected to pump means, a fluid supply chamber, at least one load chamber, outlet fluid conducting means and fluid exhaust means connected to reservoir means, first valve means for selectively interconnecting said fluid load chamber with said fluid supply chamber and said fluid exhaust means, said first valve means having first variable metering orifice means operable to throttle fluid flow between said load chamber and said fluid exhaust means and second variable orifice means operable to throttle fluid flow between said fluid supply chamber and said load chamber, load sensing port means selectively communicable with said load chamber by said first valve means, second valve means having out flow throttling means between said load chamber and said fluid exhaust means responsive to pressure upstream of said first variable orifice means, said second valve means having fluid isolating means between said fluid inlet chamber and said fluid supply chamber, fluid replenishing means to interconnect for fluid flow said fluid supply chamber and said fluid exhaust means when said fluid isolating means isolates said fluid supply chamber and said fluid inlet chamber, and control means connected to said inlet chambers of said valve assemblies, control line means interconnecting said control means with said pressure sensing port means of said valve assemblies, control signal direction phasing means in each of said control line means, said third control valve means responsive to highest pressure in any of said load chambers of valve assemblies operating loads and operable to vary fluid flow delivered from said pump means to said load system to maintain a constant pressure differential across said second variable orifice means between pressure in said inlet chambers and said maximum pressure in said load chamber.

* * * * *